US009564109B2

(12) United States Patent
Boxberger, Jr.

(10) Patent No.: US 9,564,109 B2
(45) Date of Patent: Feb. 7, 2017

(54) BASS GUITAR TO ENHANCE THE MUSICAL PERFORMANCE OF A USER

(71) Applicant: Frank Dale Boxberger, Jr., Scottsdale, AZ (US)

(72) Inventor: Frank Dale Boxberger, Jr., Scottsdale, AZ (US)

( * ) Notice: Subject to any disclaimer, the term of this patent is extended or adjusted under 35 U.S.C. 154(b) by 99 days.

(21) Appl. No.: 14/071,304

(22) Filed: Nov. 4, 2013

(65) Prior Publication Data

US 2015/0122104 A1 May 7, 2015

(51) Int. Cl.
*G10D 3/00* (2006.01)
*G10D 1/08* (2006.01)

(52) U.S. Cl.
CPC ..... *G10D 1/085* (2013.01)

(58) Field of Classification Search
USPC ..... 84/173, 318, 299, 297, 267, 268, 290, 84/291, 292, 293, 297 R, 298, 307, 84/314 R, 314 N, 453, 327
See application file for complete search history.

(56) References Cited

U.S. PATENT DOCUMENTS

| | | | | | |
|---|---|---|---|---|---|
| D158,469 | S | * | 5/1950 | Kohn | D11/48 |
| D227,804 | S | * | 7/1973 | Miller | D17/18 |
| 4,442,750 | A | * | 4/1984 | Bowley | 84/724 |
| 4,563,933 | A | * | 1/1986 | Kim | 84/267 |
| 5,189,235 | A | * | 2/1993 | Fishman et al. | 84/291 |
| 5,305,674 | A | * | 4/1994 | Fishman et al. | 84/291 |
| 5,796,025 | A | * | 8/1998 | Haake | 84/464 R |
| 7,064,259 | B1 | * | 6/2006 | Kelly | 84/464 A |
| 7,465,870 | B1 | * | 12/2008 | Homan | 84/743 |
| D664,188 | S | * | 7/2012 | Keizo | D17/20 |
| 8,975,502 | B1 | * | 3/2015 | Delgado | 84/723 |

OTHER PUBLICATIONS

URL: http://www.branchguitars.com/ Waybackmachine: https://web.archive.org/web/20100823233925/http://www.branchguitars.com/ Pertinent Page: https://web.archive.org/web/20101003035831/http://www.branchguitars.com/aluminum Date: Aug. 23 2010.*

URL: http://www.travelerguitar.com/ Wayback Machine: https://web.archive.org/web/20081221015846/http://www.travelerguitar.com/ Pertinent Page: https://web.archive.org/web/20081230180115/http://www.travelerguitar.com/travelerCatalog.pdf Date: Dec. 21, 2008.*

Ulrich Teuffel, Teuffel Birdfish, Jun. 4, 2013, http://web.archive.org/web/20120604045943/http://www.t3.com/features/electric-guitars-the-weird-and-wonderful/teuffel-birdfish-jpg.*

* cited by examiner

*Primary Examiner* — Christopher Uhlir
(74) *Attorney, Agent, or Firm* — Plager Schack LLP

(57) ABSTRACT

An electric stringed instrument for enhancing the musical or artistic performance of a user is provided. The instrument includes a body with a cutout such that a center portion of the body is open, a neck affixed to an outer edge of the body, and a plurality of strings having first ends operably connected to the neck and second ends operably connected to the body, the plurality of strings being oriented such that the strings extend over the cutout of the body. The user may maneuver the instrument and strum the plurality of strings on any portion of the strings located within the cutout of the body, thereby enhancing the sound of the instrument and the performance of the user.

9 Claims, 2 Drawing Sheets

BASS GUITAR TO ENHANCE THE MUSICAL PERFORMANCE OF A USER

BACKGROUND

The embodiments herein relate generally to electric stringed instruments. More specifically, embodiments of the invention relate to a bass guitar for enhancing a user's musical performance.

Electric stringed instruments such as the bass guitar comprise a variety of components including a body, neck, strings, bridge and one or more pickups. There exist base guitar bodies with a variety of shapes and colors. However, these current base guitar designs are limited because the bodies all comprise a solid and continuous block of wood that covers the entire area below the strings. This design can negatively affect the musician's artistic style and/or performance because the user cannot pluck or strum the strings from behind without striking the body of the guitar with a pick or the user's fingers and/or thumb. Further, the use of a solid and continuous block of wood for the guitar body contributes to greater manufacturing costs for the instrument.

As such, there is a need in the industry for a bass guitar with a modified body design that overcomes the limitations of the prior art. In particular, there is a need for a bass guitar body, which enhances the musical and/or artistic performance of the user.

SUMMARY

An electric stringed instrument for enhancing the musical or artistic performance of a user is provided. The instrument comprises a body comprising a cutout such that a center portion of the body is open, a neck affixed to an outer edge of the body, and a plurality of strings comprising first ends operably connected to the neck and second ends operably connected to the body, the plurality of strings being oriented such that the strings extend over the cutout of the body, wherein the user may maneuver the instrument and strum the plurality of strings on any portion of the strings located within the cutout of the body, thereby enhancing the sound of the instrument and the performance of the user.

BRIEF DESCRIPTION OF THE FIGURES

The detailed description of some embodiments of the invention will be made below with reference to the accompanying figures, wherein the figures disclose one or more embodiments of the present invention.

DETAILED DESCRIPTION OF CERTAIN EMBODIMENTS

Figure 1:
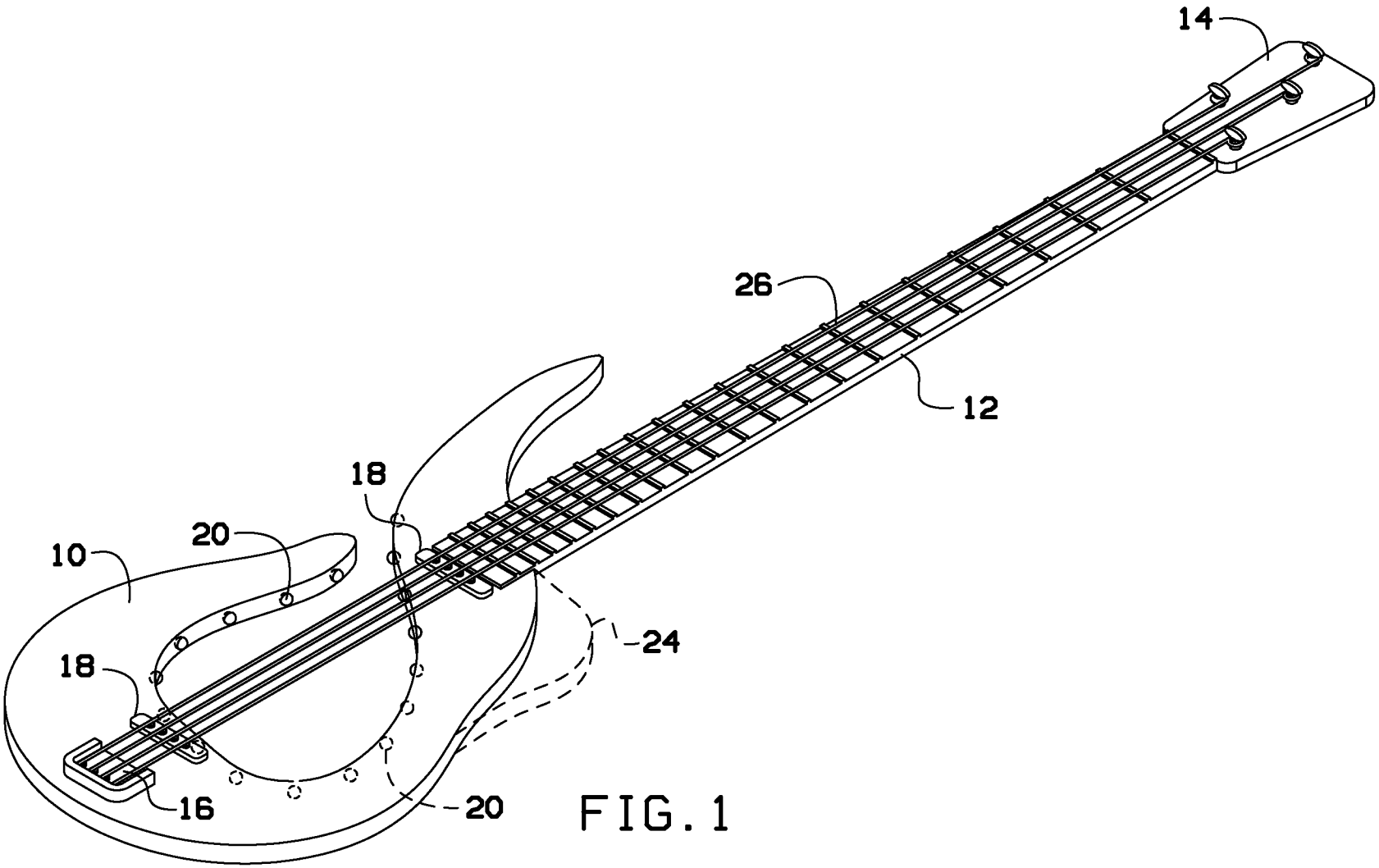
FIG. 1 depicts a perspective view of certain embodiments of the bass guitar.
Figure 2:
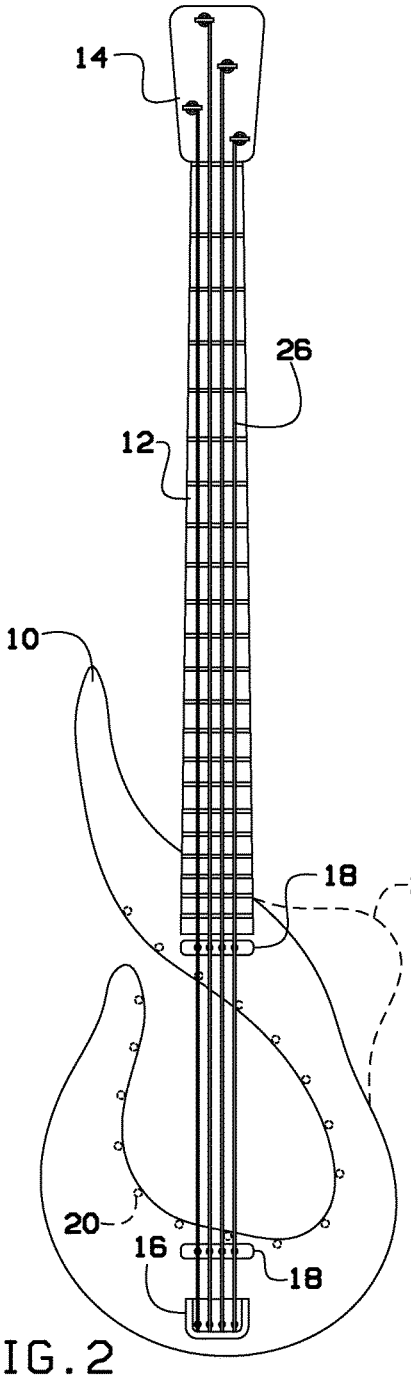
FIG. 2 depicts a top view of certain embodiments of the bass guitar.

As depicted in FIGS. 1-2, the base guitar comprises body 10, neck 12, head stock 14, bridge/pickup combination 16, pickups 18, light-emitting diodes 20, lap support 24 and strings 26. Body 10 comprises a cutout such that the center portion of the body is open. Neck 12 may include frets or may be fretless. Head stock 14 comprises tuning pegs, which may be used to tune strings 26. Strings 26 comprise first ends connected to the tuning pegs of head stock 14 and second ends connected to bridge/pickup combination 16 affixed to body 10. It shall be appreciated that bridge/pickup combination 16, pickups 18, light-emitting diodes 20 and lap support 24 are optional. Therefore, any combination of these components may be included on the bass guitar. Body 10, neck 12, head stock 14 and lap support 24 may be made from any materials known in the field such as wood. Bridge/pickup combination 16, pickups 18 and strings 26 may be made from any materials or combination of materials such as steel, nickel, or the like. In an alternative embodiment, light-emitting diodes 20 may be replaced by or used in conjunction with fiber optic lines, which are affixed to body 10.

Figure 3:
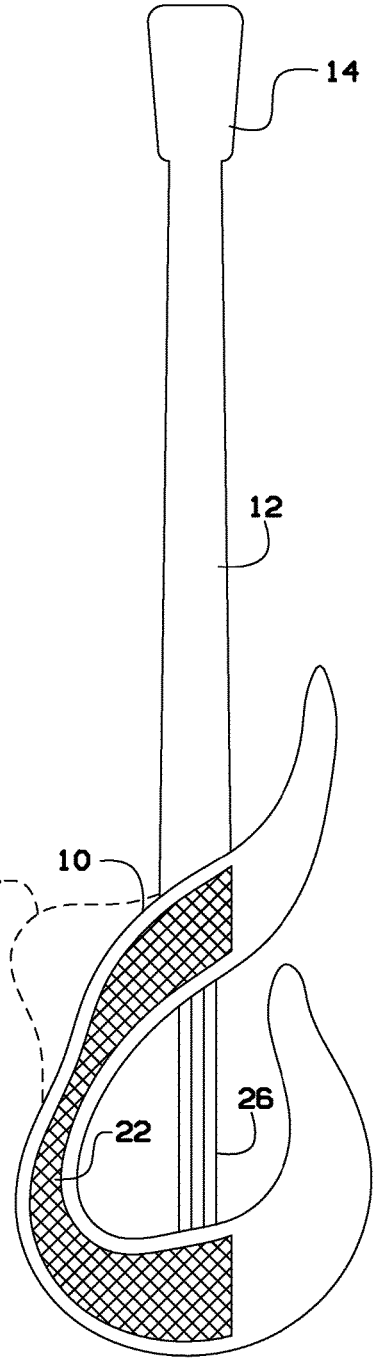
FIG. 3 depicts a bottom view of certain embodiments of the bass guitar.

As depicted in FIG. 3, the bass guitar comprises support layer 22 affixed to the back of body 10. Support layer 22 may comprise any material or combination of materials having a high tension and compression strength including, but not limited to, graphite, metal, wood, aluminum, steel, polycarbonate, or the like. Support layer 22 is configured to prevent body 10 from flexing when strings 26 are tuned, thereby minimizing the likelihood body 10 will break due to string tension or loose tuning In an alternative embodiment, support layer 22 may be affixed to the front of body 10 or embedded within body 10. It shall be appreciated that support layer 22 is not required if body 10 is made from a sufficient high strength material.

It shall be appreciated that the components of the bass guitar may be manufactured and assembled by hand or using any known machining techniques in the field. It shall be appreciated that the shape of the cutout on body 10 may vary in size and shape.

In operation, the user will generally connect the base guitar to an amplifier by a wire. The user can play the base guitar by slapping, strumming or plucking any portion of strings 26 within the cutout of body 10. The space provided by the cutout allows the user to use a variety of tools other than a pick to play the bass guitar, such as a stick, bow, or the like. As such, the cutout of body 10 allows users to enhance their musical performance, style and/or stage presence while playing the instrument. In addition, the cutout of body 10 may help the user to achieve a unique sound due to the positioning of pickups 18 on body 10 away from the cutout. The user may use lap support 24 to position the bass guitar on his/her lap. Lap support 24 conforms to the contours of the user's lap, thereby enabling him/her to play the bass guitar comfortably. In certain embodiments of the invention, the user may use light-emitting diodes 20 or fiber optic lines to illuminate strings 26 and the bass guitar to further enhance the user's musical performance.

It shall be appreciated that the components of the bass guitar described in several embodiments herein may comprise any alternate known materials in the field and be of any color, size and/or dimensions. While the embodiments described herein relate to a bass guitar, it shall be appreciated that embodiments of the invention may also apply to any other electric stringed instrument such as a guitar, violin, cello, or the like.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. An electric stringed instrument for enhancing a musical or artistic performance of a user, the instrument comprising:

a body comprising a front face, a rear face opposite the front face, and a central cutout that extends to an edge of the body to create an unobstructed opening in the edge of the body;

a neck affixed to the body; and a plurality of strings comprising first ends operably connected to the neck and second ends operably connected to the body, the plurality of strings being oriented such that the strings extend over the cutout of the body;

wherein the user may maneuver the instrument and strum the plurality of strings on any portion of the strings located within the cutout of the body, thereby enhancing a sound of the instrument and the performance of the user, wherein the cutout is sufficiently large to permit the user to strum the plurality of strings from the rear face of the body through the cutout.

2. The electric stringed instrument of claim 1 further comprising a support layer affixed to the body, wherein the support layer is configured to prevent the body from flexing.

3. The electric stringed instrument of claim 2 further comprising a plurality of light-emitting diodes affixed to an edge of the cutout of the body.

4. The electric stringed instrument of claim 2 further comprising fiber optic lines affixed to the body.

5. The electric stringed instrument of claim 2 further comprising a pickup device affixed to the body proximate to the plurality of strings.

6. The electric stringed instrument of claim 5 further comprising a bridge affixed to the body proximate to the plurality of strings.

7. The electric stringed instrument of claim 6 further comprising a support structure affixed to the body, the support structure being configured to conform to contours of a lap of the user.

8. An electric stringed instrument for enhancing a musical or artistic performance of a user, the instrument comprising:

a body comprising a front face, a rear face opposite the front face, and a central cutout that extends to an edge of the body to create an unobstructed opening in the edge of the body;

a neck affixed to the body;

a support layer affixed to a region of the body proximate the central cutout and the edge of the body to prevent the body from flexing; and a plurality of strings comprising first ends operably connected to the neck and second ends operably connected to the body, the plurality of strings being oriented such that the strings extend over the cutout of the body;

wherein the user may maneuver the instrument and strum the plurality of strings on any portion of the strings located within the cutout of the body, thereby enhancing a sound of the instrument and the performance of the user, wherein the cutout is sufficiently large to permit the user to strum the plurality of strings from the rear face of the body through the cutout.

9. The electric stringed instrument of claim 8, wherein the support layer is embedded within the body.

* * * * *